US011198540B2

(12) United States Patent
Hamel

(10) Patent No.: US 11,198,540 B2
(45) Date of Patent: Dec. 14, 2021

(54) BAG CLOSURE CLIP

(71) Applicant: KLR SYSTEMS INC., Saint-Pie (CA)

(72) Inventor: Nicolas Hamel, Saint-Pie (CA)

(73) Assignee: KLR SYSTEMS INC., Saint-Pie (CA)

( * ) Notice: Subject to any disclaimer, the term of this patent is extended or adjusted under 35 U.S.C. 154(b) by 0 days.

(21) Appl. No.: 16/582,127

(22) Filed: Sep. 25, 2019

(65) Prior Publication Data

US 2020/0095022 A1 Mar. 26, 2020

Related U.S. Application Data

(60) Provisional application No. 62/735,945, filed on Sep. 25, 2018.

(51) Int. Cl.
*B65D 33/16* (2006.01)
*B65D 33/00* (2006.01)

(52) U.S. Cl.
CPC ..... *B65D 33/1625* (2013.01); *B65D 33/004* (2013.01)

(58) Field of Classification Search
CPC ..... B65D 11/1625; B65D 33/004
See application file for complete search history.

(56) References Cited

U.S. PATENT DOCUMENTS 2,396,906 A * 3/1946 Windson ..... A63H 27/10 446/222
4,361,935 A * 12/1982 Paxton ..... B65D 33/1625 206/343
5,495,645 A * 3/1996 Suzuki ..... B65D 33/1625 24/30.5 R
5,852,851 A * 12/1998 Cooper ..... B65D 33/1625 24/30.5 R
D539,140 S * 3/2007 Irwin ..... D9/434
9,266,648 B2 * 2/2016 Marchionda ..... B65D 33/1625
D770,278 S * 11/2016 Woodring ..... D9/443
9,481,492 B2 * 11/2016 Vantrease ..... B65D 33/16
9,481,493 B2 * 11/2016 Vantrease ..... B65D 33/1625
D796,320 S * 9/2017 Woodring ..... D9/443
D871,212 S * 12/2019 Hamel ..... D9/443
D880,296 S * 4/2020 Hamel ..... D9/443
2006/0042051 A1 * 3/2006 Irwin ..... B65D 33/1625 24/30.5 S
2008/0260302 A1 * 10/2008 Martinez ..... B65D 33/1625 383/78

* cited by examiner

*Primary Examiner* — Victor D Batson
*Assistant Examiner* — Matthew J Sullivan
(74) *Attorney, Agent, or Firm* — Carlson, Gaskey & Olds, P.C.

(57) ABSTRACT

A closure clip for maintaining a bag closed is provided. The clip includes a planar body having a symmetry axis. The planar body defines a rear portion having a frontward border, a rearward border and lateral borders, a pair of shoulders, each extending outwardly and along one of the lateral borders and a pair of tabs projecting from the frontward border frontwardly and towards the symmetry axis, the tabs having free front extremities curving towards each other, the tabs and a portion of the frontward border delimiting an opening for receiving a portion of the bag. The planar body has a perimeter comprising an inflection point provided on each side of the symmetry axis, at a transition between one of the shoulders and a corresponding one of the tabs. The clip can include a displaying label projecting rearwardly from the rearward border. A strip of closure clips is also provided.

22 Claims, 9 Drawing Sheets

BAG CLOSURE CLIP

TECHNICAL FIELD

The technical field generally relates to closure devices for flexible packaging product, and more particularly concerns a closure clip for holding a bag closed.

BACKGROUND

Some plants, such as bakeries, face the challenge of displaying more information on closure clips which can be used to close a bag. However, closure clips of prior art, for example illustrated in FIG. 1 (PRIOR ART), generally have a rather small total surface area, which limits the quantity of information that may be printed and displayed on the closure clips. One alternative, illustrated for example in FIG. 2 (PRIOR ART), includes increasing the surface area of the closure clips. However, this approach typically uses more materials, which is notably associated with greater costs. Another alternative, illustrated in FIG. 3 (PRIOR ART), includes printing the required information on a paper label and sticking the paper label to a closure clip. This approach comes with some challenges, which include and are not limited to a relatively high price, the fact that the paper label is not necessary humidity-resistant, and the generally poor adherence of the paper label to the closure clip.

Because of the conventional geometrical configuration of the closure clips of prior art, it remains a challenge, both from a financial and technological point of view to print clear and readable information on such closure clips.

Closure clips can be provided in rolls, wherein each closure clip is attached to an adjacent closure clip through plastic links, as illustrated in FIG. 4 (PRIOR ART). Such plastic links are known to be problematic, as small variations in their material density could make the separation process of two adjacent closure clips unpredictable (i.e., it may be too difficult or too easy to separate two adjacent closure clips from one another). Such problems are associated with delays in the production line, which in turn could be associated to higher costs.

There is thus a need for a closure clip that addresses at least some of the challenges presented above.

SUMMARY

In accordance with one aspect, there is provided a closure clip for maintaining a bag closed, the closure clip including a planar body having a symmetry axis and defining a rear portion having a frontward border, a rearward border and lateral borders; a pair of shoulders, each shoulder extending outwardly and along a corresponding one of the lateral borders; and a pair of tabs projecting from the frontward border frontwardly and towards the symmetry axis, the pair of tabs having free front extremities curving towards each other, the pair of tabs and a portion of the frontward border delimiting a bag-receiving opening for receiving a portion of the bag therein, wherein the planar body has a perimeter including an inflection point provided on each side of the symmetry axis, at a transition between one of the shoulders and a corresponding one of the tabs.

In some embodiments, the frontward border is concave, and the rearward border is convex.

In some embodiments, the rear portion has four sides, two of the four sides being straight and parallel one to another, two others of the four sides being curvilinear.

In some embodiments, the free front extremities define a slit therebetween.

In some embodiments, the dimension of the slit ranges from about 0.008 inch to about 0.015 inch.

In some embodiments, the pair of tabs is flexible, thereby allowing a passage of the portion of the bag in or out the bag-receiving opening when the tabs are flexed.

In some embodiments, each tab is hook shaped.

In some embodiments, the rear portion, the pair of laterally spaced-apart shoulders and the pair of tabs are made of polyethylene (PE), polypropylene, acetal, acrylic, nylon (polyamides), polystyrene, polyvinyl chloride (PVC), acrylonitrile butadiene styrene (ABS), polycarbonate, or a combination thereof.

In some embodiments, the closure clip has a width ranging from about 20 mm to about 25 mm in the rear portion, a height ranging from about 20 mm to about 25 mm and a thickness ranging from about 0.7 mm to about 1.5 mm.

In some embodiments, the closure clip has a material volume ranging from about 0.1 $cm^2$ to about 0.2 $cm^2$.

In accordance with another aspect, there is provided a closure clip for holding a bag closed, the closure clip including a planar body having a symmetry axis and defining a rear portion having a frontward border, a rearward border and lateral borders; a pair of shoulders, each shoulder extending outwardly and along a corresponding one of the lateral borders; a pair of tabs projecting from the frontward border frontwardly and towards the symmetry axis, the pair of tabs having free front extremities curving towards each other, the pair of tabs and a portion of the frontward border delimiting a bag-receiving opening for receiving the bag therein; and a displaying label, the displaying label projecting rearwardly from the rearward border.

In some embodiments, the planar body has a perimeter including an inflection point provided on each side of the symmetry axis, at a transition between one of the shoulders and a corresponding one of the tabs.

In some embodiments, the rear portion has a first thickness and the displaying label has a second thickness, the second thickness being smaller than the first thickness.

In some embodiments, the frontward border is concave, and the rearward border is convex.

In some embodiments, the free front extremities define a slit therebetween.

In some embodiments, the dimension of the slit ranges from about 0.008 inch to about 0.015 inch.

In some embodiments, the pair of tabs is flexible, thereby allowing a passage of the portion of the bag in or out the bag-receiving opening when the tabs are flexed.

In some embodiments, each tab is hook shaped.

In some embodiments, the displaying label has a length ranging from about 20 mm to about 25 mm, a width ranging from about 20 mm to about 65 mm and a thickness ranging from about 0.2 mm to about 0.5 mm.

In some embodiments, the rear portion, the pair of laterally spaced-apart shoulders, the pair of tabs and the displaying label are made of polyethylene (PE), polypropylene, acetal, acrylic, nylon (polyamides), polystyrene, polyvinyl chloride (PVC), acrylonitrile butadiene styrene (ABS), polycarbonate, or a combination thereof.

In some embodiments, the displaying label has a relatively smooth surface.

In accordance with another aspect, there is provided a strip of closure clips, including a plurality of contiguous closure clips, each closure clip including a planar body having a symmetry axis and defining a rear portion having a frontward border, a rearward border and lateral borders; a pair of shoulders, each shoulder extending outwardly and along a corresponding one of the lateral borders; and a pair of tabs projecting from the frontward border frontwardly and towards the symmetry axis, the pair of tabs having free front extremities curving towards each other, the pair of tabs and a portion of the frontward border delimiting a bag-receiving opening for receiving the bag therein, wherein the planar body has a perimeter including an inflection point provided on each side of the symmetry axis, at a transition between one of the shoulders and a corresponding one of the tabs.

In some embodiments, the frontward border is concave, and the rearward border is convex.

In some embodiments, the rear portion has four sides, two of the four sides being straight and parallel one to another, two others of the four sides being curvilinear.

In some embodiments, the free front extremities define a slit therebetween.

In some embodiments, the dimension of the slit ranges from about 0.008 inch to about 0.015 inch.

In some embodiments, the pair of tabs is flexible, thereby allowing a passage of the portion of the bag in or out the bag-receiving opening when the tabs are flexed.

In some embodiments, each tab is hook shaped.

In some embodiments, the rear portion, the pair of laterally spaced-apart shoulders and the pair of tabs are made of polyethylene (PE), polypropylene, acetal, acrylic, nylon (polyamides), polystyrene, polyvinyl chloride (PVC), acrylonitrile butadiene styrene (ABS), polycarbonate, or a combination thereof.

In some embodiments, the closure clip has a width ranging from about 20 mm to about 25 mm in the rear portion, a height ranging from about 20 mm to about 25 mm and a thickness ranging from about 0.7 mm to about 1.5 mm.

In some embodiments, the closure clip has a material volume ranging from about 0.1 $cm^2$ to about 0.2 $cm^2$.

In accordance with another aspect, there is provided a strip of closure clips, including a plurality of contiguous closure clips, each closure clip including a planar body having a symmetry axis and defining a rear portion having a frontward border, a rearward border and lateral borders; a pair of shoulders, each shoulder extending outwardly and along a corresponding one of the lateral borders; a pair of tabs projecting from the frontward border frontwardly and towards the symmetry axis, the pair of tabs having free front extremities curving towards each other, the pair of tabs and a portion of the frontward border delimiting a bag-receiving opening for receiving bag therein; and a displaying label, the displaying label projecting rearwardly from the rearward border.

In some embodiments, the planar body has a perimeter including an inflection point provided on each side of the symmetry axis, at a transition between one of the shoulders and a corresponding one of the tabs.

In some embodiments, the rear portion has a first thickness and the displaying label has a second thickness, the second thickness being smaller than the first thickness.

In some embodiments, the frontward border is concave, and the rearward border is convex.

In some embodiments, the free front extremities define a slit therebetween.

In some embodiments, the dimension of the slit ranges from about 0.008 inch to about 0.015 inch.

In some embodiments, the pair of tabs is flexible, thereby allowing a passage of the portion of the bag in or out the bag-receiving opening when the tabs are flexed.

In some embodiments, each tab is hook shaped.

In some embodiments, the displaying label has a length ranging from about 20 mm to about 25 mm, a width ranging from about 20 mm to about 65 mm and a thickness ranging from about 0.2 mm to about 0.5 mm.

In some embodiments, the rear portion, the pair of laterally spaced-apart shoulders, the pair of tabs and the displaying label are made of polyethylene (PE), polypropylene, acetal, acrylic, nylon (polyamides), polystyrene, polyvinyl chloride (PVC), acrylonitrile butadiene styrene (ABS), polycarbonate, or a combination thereof.

In some embodiments, the displaying label has a relatively smooth surface.

In accordance with another aspect, there is provided a closure clip for holding a bag closed, the closure clip including a planar body defining a rear portion having a frontward border and a rearward border; a pair of shoulders projecting laterally from opposite sides of the rear portion; and a pair of tabs projecting frontwardly from the frontward border, the tabs of said pair having free front extremities curving towards each other, the pair of tabs and a portion of the frontward border delimiting a bag-receiving opening for receiving the bag therein.

In some embodiments, the frontward border is concave, and the rearward border is convex.

In accordance with another aspect, there is provided a closure clip for holding a bag closed, the closure clip including a planar body defining a rear portion having a frontward border and a rearward border; a pair of shoulders projecting laterally from opposite sides of the rear portion; a pair of tabs projecting frontwardly from the frontward border, the tabs of said pair having free front extremities curving towards each other, the pair of tabs and a portion of the frontward border delimiting a bag-receiving opening for receiving the bag therein; and a displaying label, the displaying label projecting rearwardly from the rearward border.

In some embodiments, the rear portion has a first thickness and the displaying label has a second thickness, the second thickness being smaller than the first thickness.

In some embodiments, the frontward border is concave, and the rearward border is convex.

In accordance with another aspect, there is provided a strip of closure clips, including a plurality of contiguous closure clips, each closure clip including a planar body defining a rear portion having a frontward border and a rearward border; a pair of shoulders projecting laterally from opposite sides of the rear portion; and a pair of tabs projecting frontwardly from the frontward border, the tabs of said pair having free front extremities curving towards each other, the pair of tabs and a portion of the frontward border delimiting a bag-receiving opening for receiving the bag therein.

In some embodiments, the frontward border is concave, and the rearward border is convex.

In accordance with another aspect, there is provided a strip of closure clips, including a plurality of contiguous closure clips, each closure clip including a planar body defining a rear portion having a frontward border and a rearward border; a pair of shoulders projecting laterally from opposite sides of the rear portion; a pair of tabs projecting frontwardly from the frontward border, the tabs of said pair having free front extremities curving towards each other, the pair of tabs and a portion of the frontward border delimiting a bag-receiving opening for receiving bag therein; and a displaying label, the displaying label projecting rearwardly from the rearward border.

In some embodiments, the rear portion has a first thickness and the displaying label has a second thickness, the second thickness being smaller than the first thickness.

In some embodiments, the frontward border is concave, and the rearward border is convex.

In accordance with another aspect, there is provided a bag clip for maintaining a bag closed, the clip extending along a longitudinal axis from a proximal end to a distal end, the clip defining a planar body having a first portion extending forwardly from the proximal end and left and right tabs projecting forwardly from the first portion up to the distal end; wherein the first portion includes a central transversal distal edge; wherein the central transversal distal edge and the left and right tabs define therebetween a hollow area for receiving a portion of the bag; wherein the left and right tabs include left and right distal ends each curving inwardly towards each other to define therebetween a slit for allowing passage of the bag portion up to the hollow area; and wherein the first portion comprises left and right shoulders extending outwardly from the clip body, the left and right shoulders defining left and right distal edges extending inwardly towards the respective left and right tabs.

In some embodiments, the first portion comprises a central traversal proximal edge and left and right side edges extending rearwardly from the respective left and right distal edges.

In some embodiments, the left and right side edges each extends along an axis parallel to the longitudinal axis.

In some embodiments, the left and right side edges are left and right distal side edges, the first portion further comprising left and right proximal side edges extending outwardly from the central proximal edge towards that left and right distal side edges.

In some embodiments, the central proximal edge extends along an axis that is transversal to the longitudinal axis, wherein each of the left and right proximal side edges defines an angle of between 10° and 80° with respect to the transversal axis.

In some embodiments, the angle is between 25° and 65°.

In some embodiments, the angle is between 40° and 50°.

In some embodiments, each of the left and right distal edges extends towards the left and right tabs along a distance of between 0.5 mm and 5 mm.

In some embodiments, the distance is between 1 mm and 3 mm.

Other features and advantages of the present description will become more apparent upon reading of the following non-restrictive description of specific embodiments thereof, given by way of example only with reference to the accompanying drawings.

DETAILED DESCRIPTION

Figure 1:
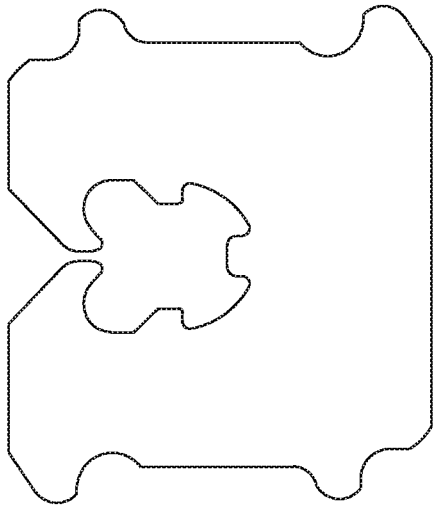
FIG. 1 (PRIOR ART)
FIGS. 1 to 3 illustrate different variants of closure clips (PRIOR ART).
Figure 2:
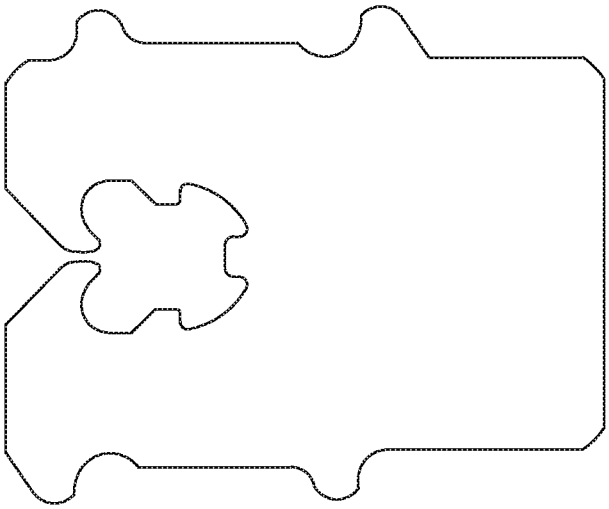
FIG. 2 (PRIOR ART)
Figure 3:
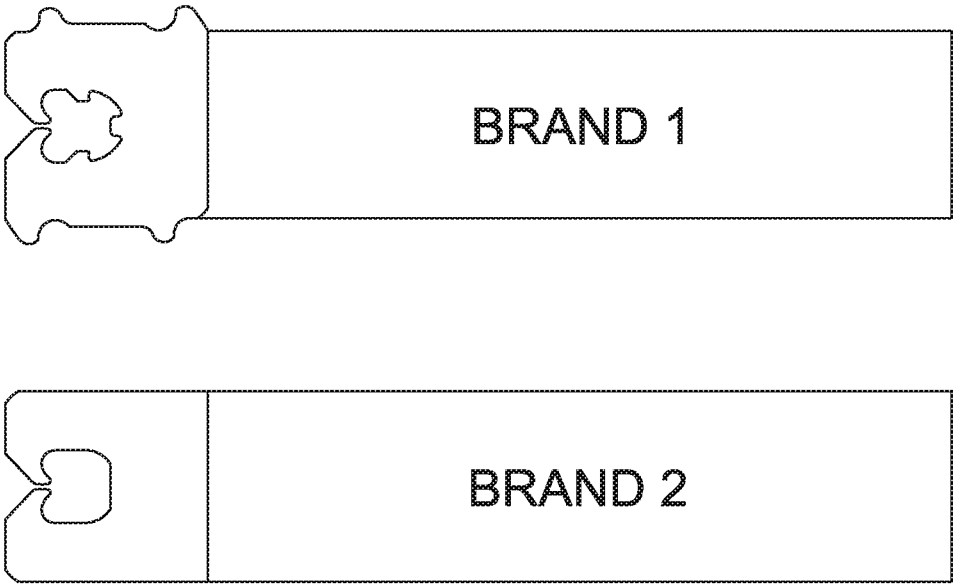
FIG. 3 (PRIOR ART)
Figure 4:
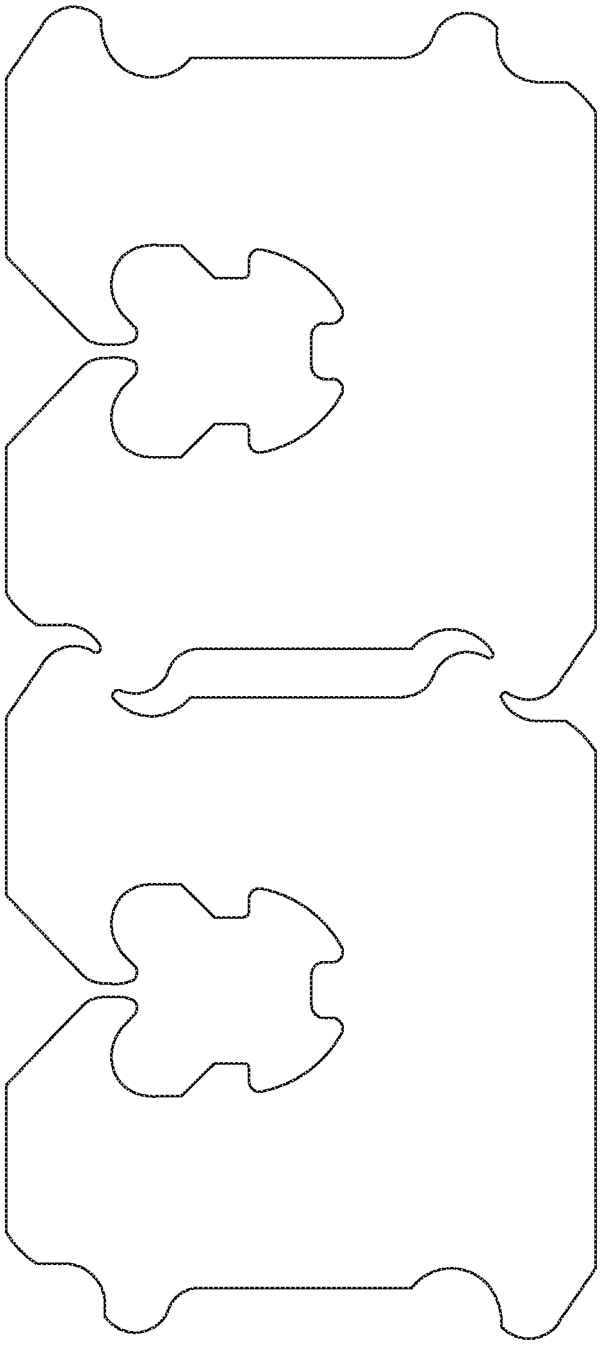
FIG. 4 (PRIOR ART)
FIG. 4 shows a strip of closure clips (PRIOR ART).

In the following description, similar features in the drawings have been given similar reference numerals, and, to not unduly encumber the figures, some elements may not be indicated on some figures if they were already identified in one or more preceding figures. It should also be understood herein that the elements of the drawings are not necessarily depicted to scale, since emphasis is placed upon clearly illustrating the elements and structures of the present embodiments.

The terms "a", "an" and "one" are defined herein to mean "at least one", that is, these terms do not exclude a plural number of elements, unless stated otherwise. It should also be noted that terms such as "substantially", "generally" and "about", that modify a value, condition or characteristic of a feature of an exemplary embodiment, should be understood to mean that the value, condition or characteristic is defined within tolerances that are acceptable for the proper operation of this exemplary embodiment for its intended application.

It will be appreciated that positional descriptors indicating the position or orientation of one element with respect to another element are used herein for ease and clarity of description and should, unless otherwise indicated, be taken in the context of the figures and should not be considered limiting. It will be understood that spatially relative terms (e.g., "frontward" and "rearward", "front" and "rear", "opposite" and "adjacent", and "frontwardly", "rearwardly" and "laterally") are intended to encompass different positions and orientations in use or operation of the present embodiments, in addition to the positions and orientations exemplified in the figures.

The expression "convex border" herein refers to a segment defining a portion of a convex shape, namely a shape in which no line segment between two points on its boundary goes outside the shape. The expression "concave border" herein refers to a segment defining a portion of a concave shape, namely a shape that is not convex.

Closure Clip

Figure 6A:
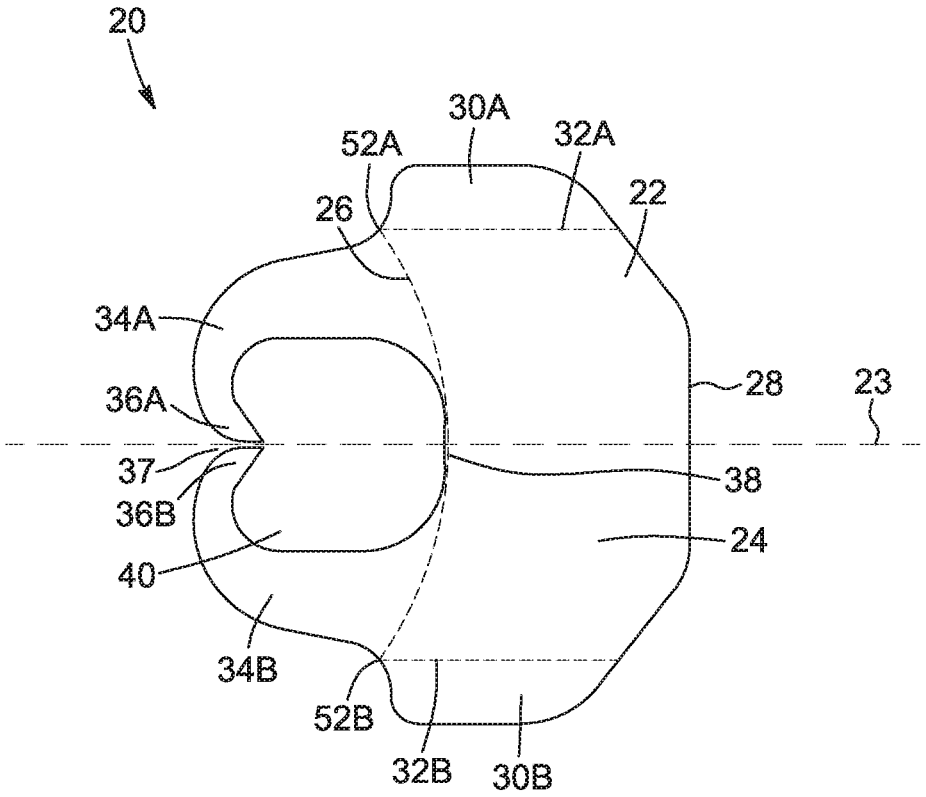
FIGS. 6A-B are an illustration of a closure clip for holding bag closed, in accordance with one embodiment.
Figure 6B:
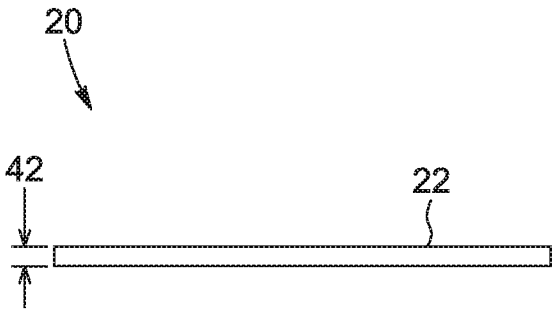

With reference to FIGS. 6A-B, there is shown an embodiment of a closure clip 20 for holding a bag closed.

The closure clip 20 includes a planar body 22. In the depicted embodiment, the planar body 22 has a mushroom-shaped profile, but one would readily understand that the profile of the planar body 22 could vary. The planar body 22 has a symmetry axis 23. In some embodiments, the symmetry axis 23 is a line that passes through the planar body 22 and separate the same in two portions having substantially the same shape, i.e., each side (i.e., each portion located on one side or another of the symmetry axis 23) is a mirror image. As such, if the planar body 22 would be folded in half along the symmetry axis 23, then the two halves would match up.

Figure 5:
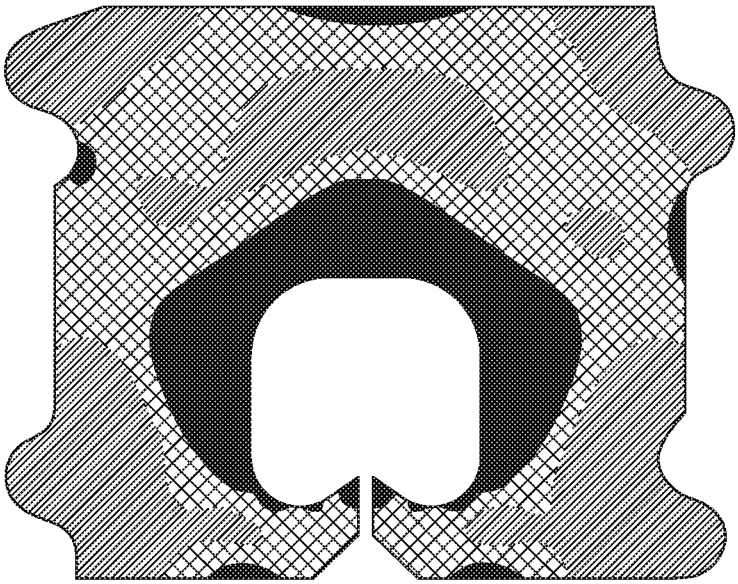
FIG. 5 illustrates a force distribution mapping of a closure clip of prior art, when the closure clip of prior art is used to close a bag.

For example, in some embodiments, the profile of the planar body 22 is based on an analysis of the force distribution within a closure clip of prior art. Now referring to FIG. 5, such an analysis can inform on the region(s) of the closure clip where the applied force is low or even null, i.e., region(s) which does not actively contribute to maintaining the bag closed when the closure clip is applied to the bag. Such region(s) of low or null applied force can be omitted from the design (i.e., the general shape or the profile) of the planar body 22 of the closure clip 20 illustrated in FIGS. 6A-B, such that almost every region of the planar body 22 contributes to maintaining the bag closed.

Now turning back to FIGS. 6A-B, the planar body 22 defines a rear portion 24. The illustrated rear portion 24 has four sides including a frontward border 26, a rearward border 28 and two opposite borders 32A,B. In some embodiments, the rearward border 28 is convex, and so is sometimes referred to as the "rearward convex border". In some embodiments, the frontward border 26 is concave, and so is sometimes referred to as the "frontward concave border".

In some embodiments, two of the four sides are straight (referred to as "straight sides"), and the two others are curvilinear (i.e., non-straight sides, also referred to as "curvilinear sides"). More particularly, the two straight sides can be parallel with respect to one another. The two curvilinear sides can each follow a respective arc, i.e. a segment of a curve.

In the illustrated embodiment, one of the two curvilinear sides defines the frontward border 26, while another of the two curvilinear edges defines the rearward border 28. It is to be noted that the rearward border 28 is a segment of the closure clip 20 outer periphery, while the frontward border 26 is an inner boundary between different regions of the planar body 22, as it will be described in greater detail below.

As shown in FIGS. 6A-B, the rearward border 28 has a general curvilinear profile but comprises a central straight segment. For example, and without being limitative, the rearward border 28 could comprise a substantially straight segment between two substantially curvilinear segments. In this example, the substantially straight segment could represent approximatively one third of the rearward border total length of the rearward border 28. The frontward border 26 can also have a general curvilinear profile.

The closure clip 20 also includes a pair of shoulders 30A,B (referred to as "the shoulders").

The shoulders 30A,B project laterally from opposite borders 32A,B of the rear portion 24, and so are laterally-spaced apart. In the depicted embodiment of FIGS. 6A-B, each one of the shoulders 30A,B projects from a respective one of the two straight edges (i.e., the borders 32A,B) of the planar body 22. Each shoulder 30A,30B extends outwardly and along a corresponding one of the lateral borders 32A,B. The shoulders 30A,B can extend along an entire length of the corresponding one of the lateral borders 32A,B.

It is to be noted that the shoulders 30A,B are integral with the rear portion 24 of the planar body 22, i.e., the shoulders 30A,B and the rear portion 24 form one single continuous area. In one embodiment, the two shoulders 30A,B and the planar body 22 define an integrated piece which could be, for example and without being limitative, substantially reniform or "bean-shaped", i.e., having a general shape substantially resembling a bean. It will be readily understood that the shape formed by the shoulders 30A,B and the rear portion 24 could also vary.

The planar body 22 also includes a pair of tabs 34A,B (referred to as "the tabs").The tabs 34A,B project frontwardly from the frontward border 26. In the depicted embodiments, each shoulder 30A,B projects from the frontward border 26 and towards the symmetry axis 23.

The tabs 34A,B each have a corresponding free front extremities 36A,B at a distal portion. The free front extremities 36A,B curve towards each other and define a slit 37 therebetween, through which the bag can be inserted. For example, and without being limitative the dimensions of the slit 37 could range from about 0.008 to 0.015 inch.

The planar body 22 has a perimeter that includes an inflection point provided on each side of the symmetry axis 23, at a transition between one of the shoulders 30A,B and a corresponding one of the tabs 34A,B. In the illustrated embodiment of FIG. 6A, the planar body 22 includes two inflections points 52A,B, respectively provided at the transition between the shoulder 30A and the tab 34A, and the transition between the shoulder 30B and the tab 34B. The inflection points 52A,B are such that the width of the closure clip 20 in the tabs region is smaller than the width of the closure clip 20 in the shoulder portion.

The tabs 34A,B are generally flexible, and can be deformed by applying a force to the tabs 34A,B. For example, applying a force of opposite direction to each one of the tabs 34A,B temporarily deforms each of the tabs 34A,B, which results in an enlargement of the slit 37 and allows a user to engage or disengage the bag from the closure clip 20. As this force can be applied by the fingers of the user, the tabs 34A,B are also sometimes referred to as a finger accessible portion.

In the context of the current disclosure, the term "flexible" refers to the property of a material to deform elastically, and more particularly to alternate between an original shape and a deformed shape upon application or removal of an external force (i.e., an applied stress). As such, the tabs 34A,B are said to be flexible because they can be flexed so as to allow the passage in or out the closure clip 20, for example and without being limitative by the fingers of the user or by a machine for applying the closure clip to the bag.

As it has been previously mentioned, the tabs 34A,B projects from the frontward border 26 of the planar body 22. It is to be noted that, similarly to the shoulders 30A,B, the tabs 34A,B are also integral with the planar body 22. Indeed, the tabs 34A,B are integral with the planar body 22 at the frontward border 26, and project therefrom.

In the depicted embodiment, the tabs 34A,B each have a shape substantially resembling a hook. More particularly, a respective proximal portion of the tabs 34A,B is affixed to the planar body 22 (at the frontward border 26). As illustrated, the tabs 34A,B are symmetrical to one another on either side of an axis passing through the slit 37. Alternatively, the tabs 34A,B could be asymmetrical.

It will be readily understood that the general shape of each one of the tabs 34A,B could vary, and could be, for example and without being limitative, L-shaped.

The pair of tabs 34A,B is positioned and shaped so that the tabs 34A,B define a bag-receiving opening 40 (sometimes referred to as an "internal aperture" or an "access opening") to receive the flexible packaging product therein, after a passage through the slit 37. The bag-receiving opening 40 is confined between the pair of tabs 34A,B and a portion 38 of the frontward border 26 but remains accessible through the slit 37, i.e., the pair of tabs 34A,B and the portion 38 of the border 26 delimit the bag-receiving opening 40 for receiving the bag therein.

It will be readily understood that while the shape of the bag-receiving opening 40 is illustrated as being a squircle (i.e., the shape intermediate between a square and a circle), the shape could vary, and for example and without being imitative, the bag-receiving opening 40 could have the shape of a cardioid, a circle, a square, a butterfly or any other shapes which would allow a bag to be received therein.

The closure clip 20, namely the planar body 22, the pair of laterally spaced-apart shoulders 30A,B and the pair of tabs 34A,B, can be made of plastic materials, which could include but are not limited to polyethylene (PE), polypropylene, acetal, acrylic, nylon (polyamides), polystyrene, polyvinyl chloride (PVC), acrylonitrile butadiene styrene (ABS), polycarbonate, combinations thereof, or any other similar material(s).

While the flexible characteristics of the closure clip 20 can be attributed to the material(s) which forms it, it will be appreciated that the dimensions, as well as the geometrical configuration of the closure clip 20 also contributes to the flexibility of the closure clip 20.

In one embodiment, the closure clip 20 has dimensions ranging from about 20 mm to about 25 mm by about 20 mm to about 25 mm by about 0.7 mm to about 1.5 mm (width×height×thickness).

In some embodiments, the volume of the closure clip 20 is about 0.1 $cm^2$. Alternatively, the volume of the closure clip 20 could range between about 0.1 to about 0.2 $cm^2$.

It is to be noted that, in some embodiments, the closure clip 20, having the dimensions and geometrical configurations presented above, allows the production of closure clips using less material than during the production of conventional closure clips (i.e., clips from the prior art). For example, in some implementations, the closure clip 20 uses between about 30% to about 35% less material than conventional closure clips. This amount of saved plastic could then be used to produce a displaying label, as it will be described in the following section.

Closure Clip with a Displaying Label

Figure 7A:
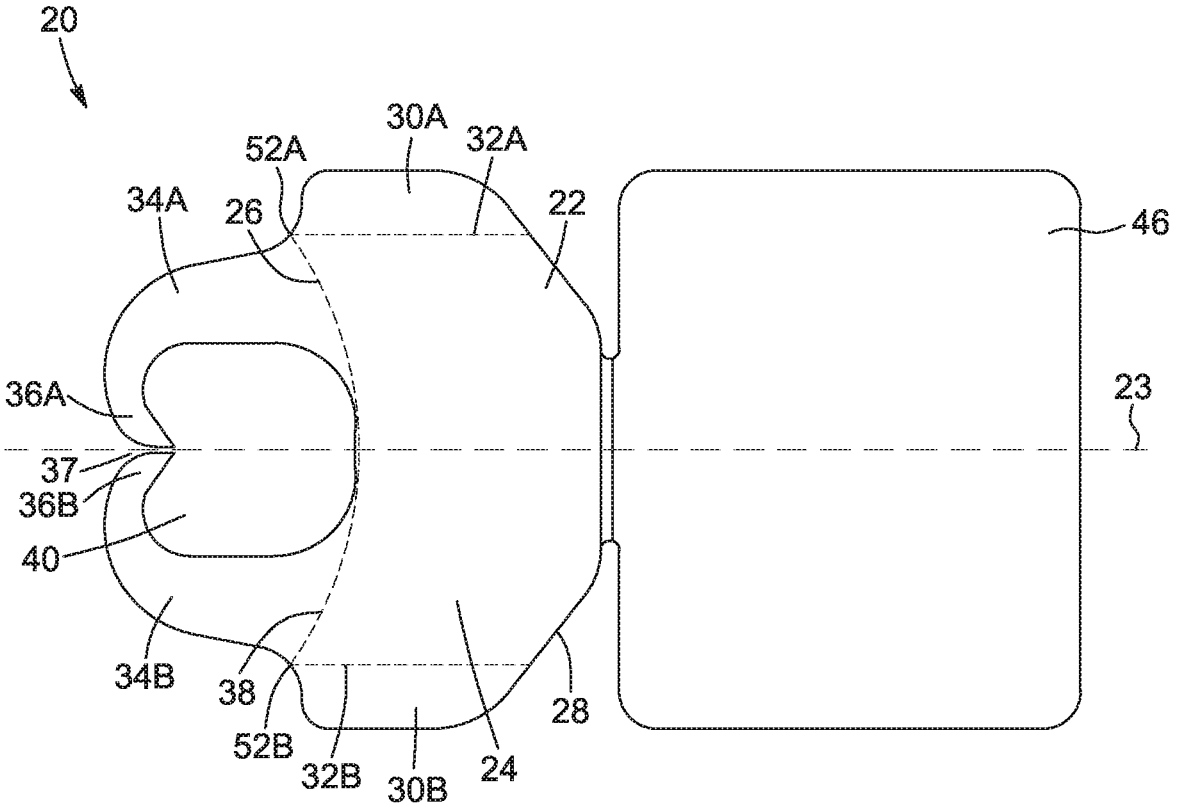
FIGS. 7A-B are an illustration of a closure clip for holding a bag closed, in accordance with another embodiment.
Figure 7B:
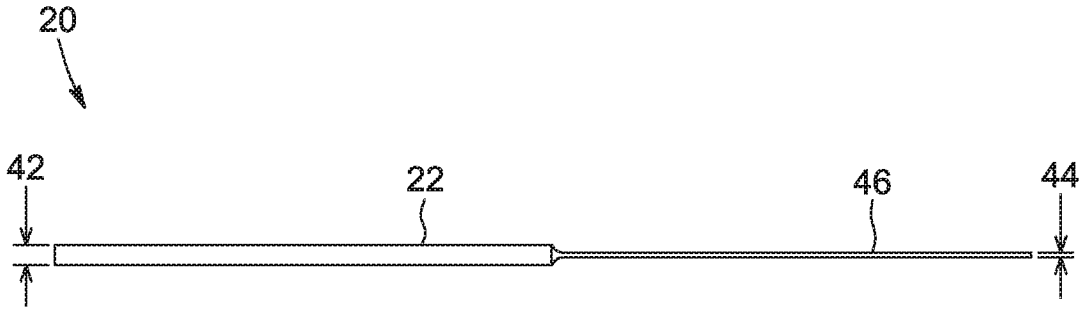

Now turning to FIGS. 7A-B, another embodiment of the closure clip 20 is shown. This embodiment is somewhat similar to the embodiments which have been previously described, but further includes a displaying label 46 (sometimes referred to as a "flag" or a "displaying portion"). As such, this embodiment of the closure clip 20 can include the planar body 22 defining the rear portion 24, the shoulders 30A,B and the tabs 34A,B similar to the ones which have been presented above.

The displaying label 46 projects rearwardly from the rearward border 28.

Generally described, the displaying label 46 is sized for receiving printed information thereon and positioned such that a user could see the information printed on the displaying label. Relevant information includes, but are not limited to packaging date, expiration date, factory number, line number, operator number, and the like.

In some embodiments, the displaying label 46 is integral with the planar body 22, i.e., the displaying label 46 and the planar body 22 form a single and integrated piece. As shown in the depicted embodiment, the displaying label 46 is integral with the planar body 22 at the rearward border 28.

In some embodiments, the displaying label 46 is provided along a straight segment of the rearward border 28.

It will be readily understood that the shape and geometrical configuration of the displaying label 46 could vary according to one's needs. In some embodiments, the displaying label 46 is substantially square. Alternatively, the displaying label 46 could be round, rectangular, polygonal or any other shapes.

As for its dimensions, the displaying label 46 can have a length ranging from about 20 mm to about 25 mm, a width ranging from about 20 cm to about 65 mm, and a thickness ranging from about 0.2 mm to about 0.5 mm.

In some embodiments, the planar body 22 has a first thickness 42 and the displaying label 46 has a second thickness 44. The second thickness 44 is smaller than the first thickness 42, which means that the displaying label 46 is thinner than the other regions of the closure clip 20 (i.e., a portion thereof, including. the planar body 22, the shoulders 30A,B and/or the pair of tabs 34A,B).

Figure 8:
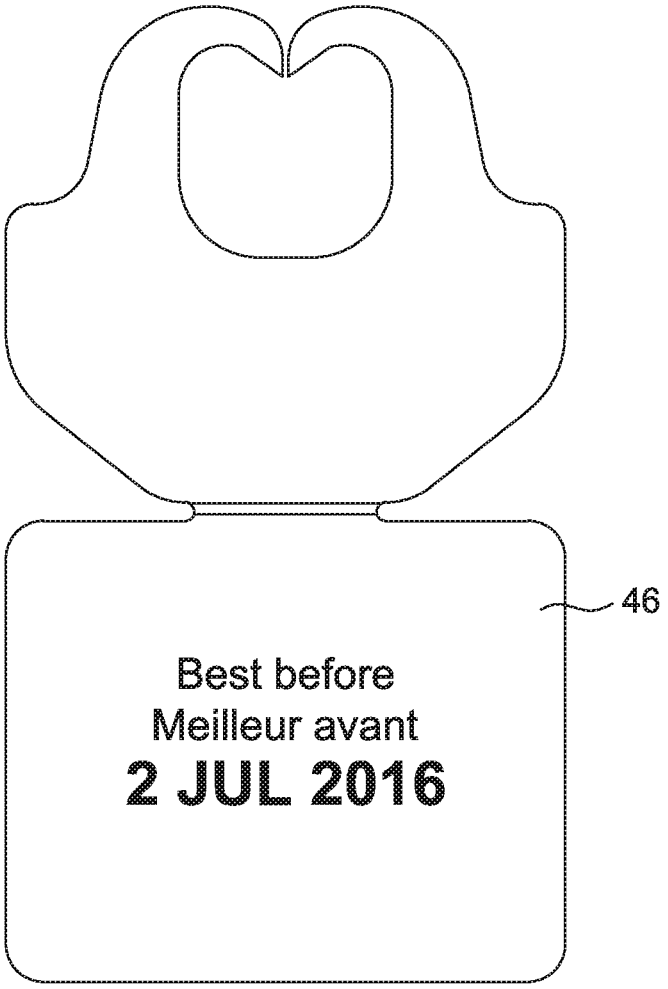
FIG. 8 shows a displaying label of a closure clip, in accordance with one embodiment.

With reference to FIGS. 7 and 8, the second thickness 44 is such that conventional printers, such as, for example and without being imitative, inkjet printers or thermal-transfer printers can be used to print information on the displaying label 46 with a resolution that allows the user to read the information (see for example FIG. 8).

As it will be described later in greater details when presenting the manufacturing method of the closure clip 20, the displaying label 46 can be extruded from the plastic forming the planar body 22, i.e., the pair shoulders 30A,B and/or the pair of tabs 34A,B. Hence, similarly to the rest of the closure clip 20, the displaying label 46 can be made of plastic material including but not limited to polyethylene (PE), polypropylene, acetal, acrylic, nylon (polyamides), polystyrene, polyvinyl chloride (PVC), acrylonitrile butadiene styrene (ABS), polycarbonate, combinations thereof, or any other similar material(s).

In some embodiments, the displaying label 46 has a relatively smooth (i.e., flat) surface. The surface typically has the necessary characteristics (e.g., roughness) which allow a clear printing (i.e., a resolution that allows a proper reading of the information printed on the displaying label 46).

In some embodiments, the total volume of material used for the fabrication of the closure clip 20 including the displaying label 46 is similar to the total volume of material used for the fabrication of conventional closure clips. However, for the same total volume of material, the surface of the closure clip 20 is larger than the surface of the conventional clips, which results in an increased printable zone.

Strip of Closure Clips

Figure 9:
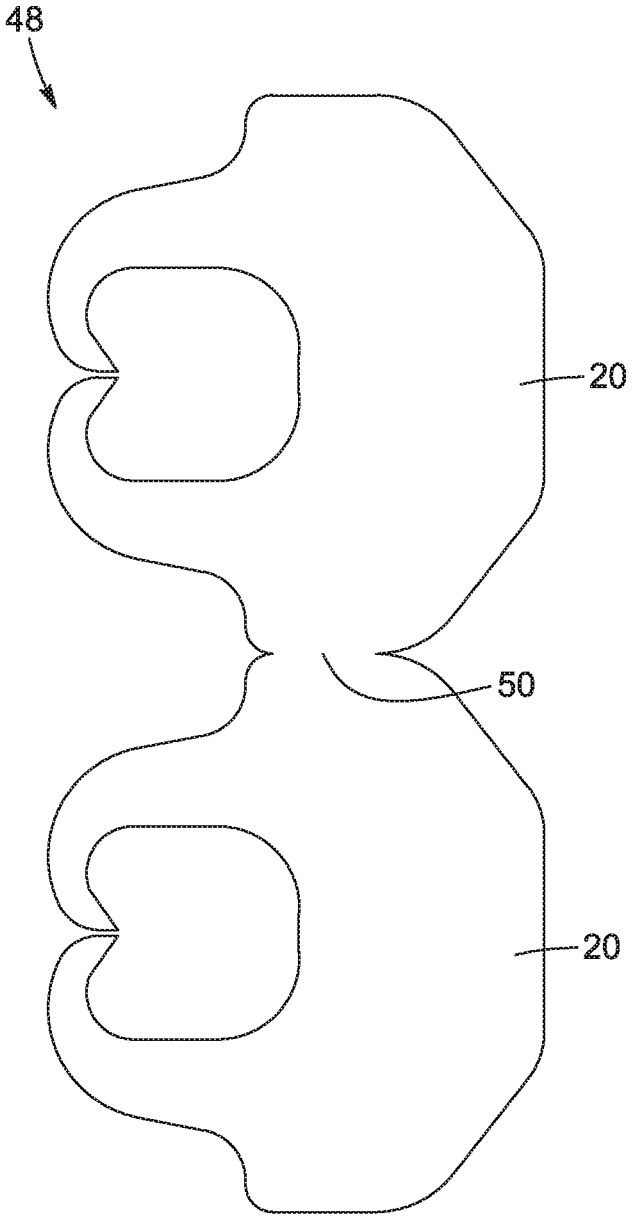
FIG. 9 is an illustration of a strip of closure clips, in accordance with one embodiment.
Figure 10:
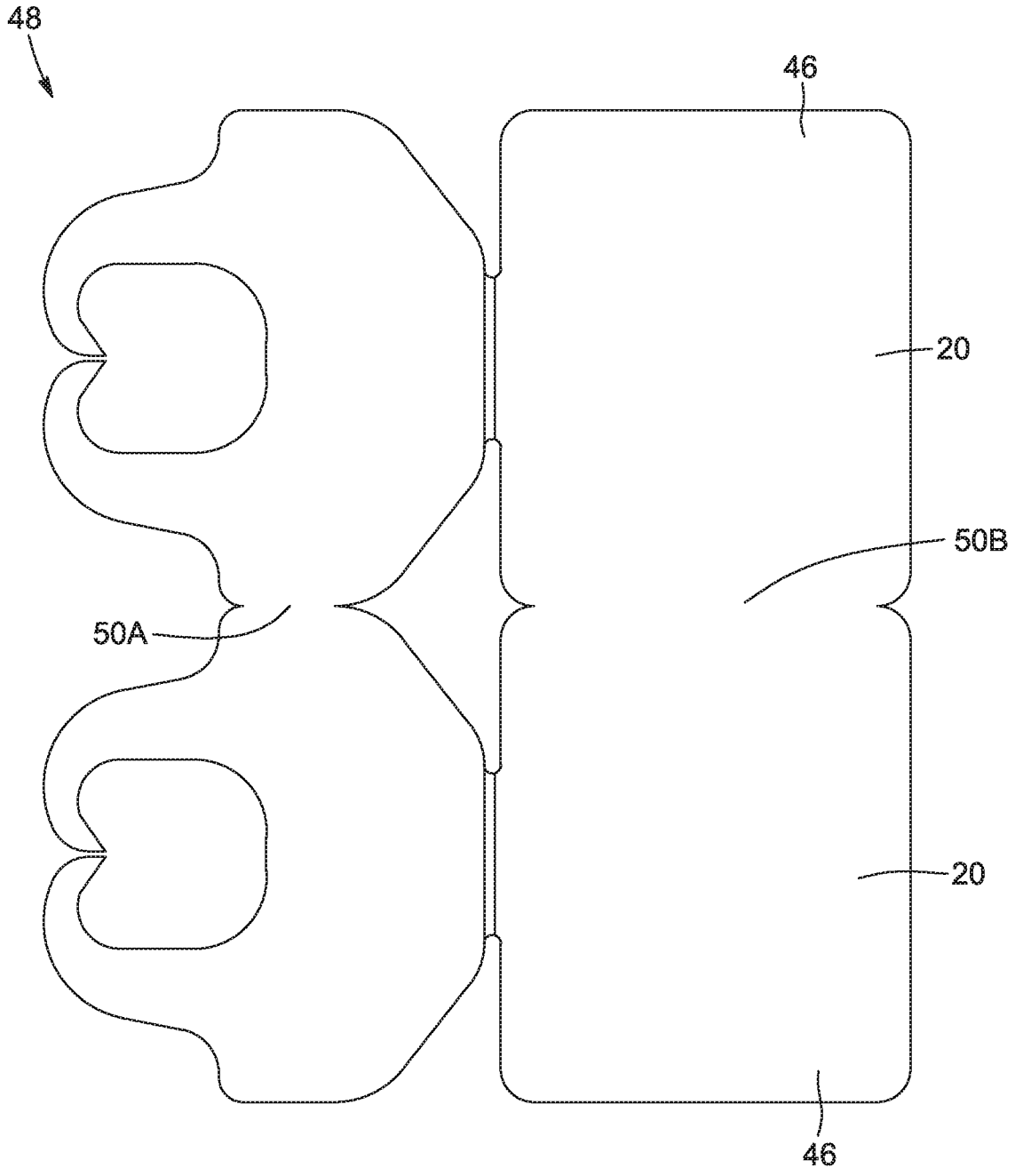
FIG. 10 is an illustration of a strip of closure clips, in accordance with another embodiment.

Now referring to FIGS. 9 and 10, two embodiments of a strip of closure clips 48 are illustrated.

The strip of closures clips 48 includes a plurality of contiguous closure clips 20, each closure clip being for holding a bag closed. The closure clips 20 can be similar to some embodiments of the closure clips which have been previously described.

For example, the strip of closure clips 48 illustrated in FIG. 9 can include closure clips 20 similar to the one described with reference to FIGS. 6A-B.

In another example, the strip of closure clips 48 illustrated in FIG. 10 can include closure clips 20 similar to the one described with reference to FIGS. 7A-B, i.e. including a displaying label 46.

In some embodiments, two neighbouring closure clips 20 of the strip of closure clips 48 are joined at a portion of their respective periphery, hence forming a linking zone 50 therebetween. When the closure clip 20 includes a displaying flag (as illustrated in FIG. 10, for example), the linking zone can be separated into two portions 50A,B, e.g., one portion being in contact with two neighbouring shoulders and another one potion being in contact with two neighbouring displaying labels.

In this configuration, each one of the closure clips 20 is integral with at least one neighbouring closure clip 20. As such, when the strip of closure clips 48 is provided in roll, the roll is made from a continuous strip of closure clips 48. Each one of the closure clips 20 forming the strip of closure clips 48 will be separated from their neighbouring closure clip(s) 20 once the bag is inserted within the bag-receiving opening using a cutting system.

In some embodiments, neighbouring and adjacent closure clips 20 share a common border along which could be applied a shear force to separate the adjacent closure clips 20 from one another.

Several alternative embodiments and examples have been described and illustrated herein. The embodiments described above are intended to be exemplary only. A person skilled in the art would appreciate the features of the individual embodiments, and the possible combinations and variations of the components. A person skilled in the art would further appreciate that any of the embodiments could be provided in any combination with the other embodiments disclosed herein. The present examples and embodiments, therefore, are to be considered in all respects as illustrative and not restrictive. Accordingly, while specific embodiments have been illustrated and described, numerous modifications come to mind without significantly departing from the scope defined in the appended claims.

The invention claimed is:

1. A closure clip for maintaining a bag closed, the closure clip comprising:

a planar body having a symmetry axis and defining:

a rear portion having a frontward border, a rearward border and lateral borders, wherein the frontward border is concave and the rearward border is convex;

a pair of shoulders, each shoulder extending laterally outward from the symmetry axis and along a corresponding one of the lateral borders; and a pair of tabs projecting from the frontward border frontwardly and towards the symmetry axis, the pair of tabs having free front extremities curving towards each other, the pair of tabs and a portion of the frontward border delimiting a bag-receiving opening for receiving a portion of the bag therein, and the pair of tabs are laterally inwards of the shoulders, wherein the planar body has a perimeter comprising an inflection point provided on each side of the symmetry axis, at a transition between one of the shoulders and a corresponding one of the tabs.

2. The closure clip of claim 1, wherein the free front extremities define a slit therebetween.

3. The closure clip of claim 1, wherein the pair of tabs is flexible, thereby allowing a passage of the portion of the bag in or out the bag-receiving opening when the tabs are flexed.

4. The closure clip of claim 1, wherein the closure clip has a width ranging from about 20 mm to about 25 mm in the rear portion, a height ranging from about 20 mm to about 25 mm and a thickness ranging from about 0.7 mm to about 1.5 mm, the closure clip having a material volume ranging from about 0.1 $cm^2$ to about 0.2 $cm^2$.

5. A closure clip for maintaining a bag closed, the closure clip comprising:

a planar body having a symmetry axis and defining:

a rear portion having a frontward border, a rearward border and lateral borders, wherein the frontward border is concave and the rearward border is convex;

a pair of shoulders, each shoulder extending laterally outward from the symmetry axis and along a corresponding one of the lateral borders;

a pair of tabs projecting from the frontward border frontwardly and towards the symmetry axis, the pair of tabs having free front extremities curving towards each other, the pair of tabs and a portion of the frontward border delimiting a bag-receiving opening for receiving the bag therein, and the pair of tabs are laterally inwards of the shoulders; and a displaying label, the displaying label projecting rearwardly from the rearward border.

6. The closure clip of claim 5, wherein the planar body has a perimeter comprising an inflection point provided on each side of the symmetry axis, at a transition between one of the shoulders and a corresponding one of the tabs.

7. The closure clip of claim 5, wherein the rear portion has a first thickness and the displaying label has a second thickness, the second thickness being smaller than the first thickness.

8. The closure clip of claim 5, wherein the free front extremities define a slit therebetween.

9. The closure clip of claim 5, wherein the pair of tabs is flexible, thereby allowing a passage of the portion of the bag in or out the bag-receiving opening when the tabs are flexed.

10. The closure clip of claim 5, wherein the displaying label has a length ranging from about 20 mm to about 25 mm, a width ranging from about 20 mm to about 65 mm and a thickness ranging from about 0.2 mm to about 0.5 mm.

11. A strip of closure clips, comprising:

a plurality of contiguous closure clips, each closure clip comprising a planar body having a symmetry axis and defining:

a rear portion having a frontward border, a rearward border and lateral borders, wherein the frontward border is concave and the rearward border is convex;

a pair of shoulders, each shoulder extending laterally outward from the symmetry axis and along a corresponding one of the lateral borders; and a pair of tabs projecting from the frontward border frontwardly and towards the symmetry axis, the pair of tabs having free front extremities curving towards each other, the pair of tabs and a portion of the frontward border delimiting a bag-receiving opening for receiving the bag therein, and the pair of tabs are laterally inwards of the shoulders, wherein the planar body has a perimeter comprising an inflection point provided on each side of the symmetry axis, at a transition between one of the shoulders and a corresponding one of the tabs.

12. The strip of closure clips of claim 11, wherein the free front extremities define a slit therebetween.

13. The strip of closure clips of claim 11, wherein the closure clip has a width ranging from about 20 mm to about 25 mm in the rear portion, a height ranging from about 20 mm to about 25 mm and a thickness ranging from about 0.7 mm to about 1.5 mm, the closure clip having a material volume ranging from about 0.1 $cm^2$ to about 0.2 $cm^2$.

14. A strip of closure clips, comprising:

a plurality of contiguous closure clips, each closure clip comprising a planar body having a symmetry axis and defining:

a rear portion having a frontward border, a rearward border and lateral borders, wherein the frontward border is concave and the rearward border is convex;

a pair of shoulders, each shoulder extending laterally outward from the symmetry axis and along a corresponding one of the lateral borders;

a pair of tabs projecting from the frontward border frontwardly and towards the symmetry axis, the pair of tabs having free front extremities curving towards each other, the pair of tabs and a portion of the frontward border delimiting a bag-receiving opening for receiving bag therein, and the pair of tabs are laterally inwards of the shoulders; and a displaying label, the displaying label projecting rearwardly from the rearward border.

15. The strip of closure clips of claim 14, wherein the planar body has a perimeter comprising an inflection point provided on each side of the symmetry axis, at a transition between one of the shoulders and a corresponding one of the tabs.

16. The strip of closure clips of claim 14, wherein the rear portion has a first thickness and the displaying label has a second thickness, the second thickness being smaller than the first thickness.

17. The strip of closure clips of claim 14, wherein the free front extremities define a slit therebetween.

18. The strip of closure clips of claim 14, wherein the displaying label has a length ranging from about 20 mm to about 25 mm, a width ranging from about 20 mm to about 65 mm and a thickness ranging from about 0.2 mm to about 0.5 mm.

19. The closure clip of claim 1, wherein each shoulder extends along an entire length of the corresponding one of the lateral borders.

20. The closure clip of claim 1, wherein the frontward border extends from one of the inflection points towards another one of the inflection points.

21. The closure clip of claim 5, wherein the displaying label and the planar body form one single continuous area.

22. The closure clip of claim 5, wherein the displaying label is made from a material extruded from the planar body.

* * * * *